US011867003B2

(12) United States Patent
Ward et al.

(10) Patent No.: US 11,867,003 B2
(45) Date of Patent: Jan. 9, 2024

(54) SEALED CONCENTRIC COILED TUBING

(71) Applicant: ConocoPhillips Company, Houston, TX (US)

(72) Inventors: Dustin K. Ward, Houston, TX (US); Jing H. Chow, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 17/370,714

(22) Filed: Jul. 8, 2021

(65) Prior Publication Data

US 2022/0010632 A1 Jan. 13, 2022

Related U.S. Application Data

(60) Provisional application No. 63/049,376, filed on Jul. 8, 2020.

(51) Int. Cl.
*E21B 17/20* (2006.01)

(52) U.S. Cl.
CPC ..... *E21B 17/20* (2013.01); *E21B 17/203* (2013.01)

(58) Field of Classification Search
CPC ..... E21B 17/012; E21B 17/18; E21B 17/20; E21B 17/203; E21B 17/00; F16L 7/02; F16L 9/18; F16L 11/20
See application file for complete search history.

(56) References Cited

U.S. PATENT DOCUMENTS 1,746,132 A * 2/1930 Stokes ..... E21B 44/005 285/123.14
1,781,049 A * 11/1930 Brinton ..... E21B 17/00 175/320
2,743,905 A * 5/1956 Eckel ..... E21B 21/10 166/325
4,308,917 A * 1/1982 Dismukes ..... E21B 43/10 166/381
4,997,048 A * 3/1991 Isom ..... E21B 17/003 166/57
5,988,702 A * 11/1999 Sas-Jaworsky ..... E21B 17/20 285/259

(Continued)

FOREIGN PATENT DOCUMENTS

FR 3028592 A1 * 5/2016 ..... F16L 53/008
WO WO-02092955 A2 * 11/2002 ..... E21B 17/18
WO WO-2021116452 A1 * 6/2021 ..... F16L 1/19

OTHER PUBLICATIONS

International Search Report and Written Opinion of The International Searching Authority for PCT/US2021/040902 dated Oct. 13, 2021 (8 pages).

*Primary Examiner* — Jennifer H Gay
(74) *Attorney, Agent, or Firm* — Polsinelli PC

(57) ABSTRACT

Implementations described and claimed herein provide systems and methods for extending reach in a wellbore in oil well operations. In one implementation, a first coiled tubing string has a first coil interior surface, and a second coiled tubing string is disposed within the first coiled tubing string and has a second coil exterior surface. An annulus is defined by the first coil interior surface and the second coil exterior surface. The annulus is sealed proximal to a top end of the first coiled tubing string via a first seal and sealed proximal to a bottom end of the first coiled tubing string via a second seal. A fluid is sealed within the annulus at a pressure.

20 Claims, 6 Drawing Sheets

(56) References Cited

U.S. PATENT DOCUMENTS 5,996,689 A 12/1999 Head
6,015,015 A * 1/2000 Luft ..... E21B 17/1007 166/57
6,443,244 B1 * 9/2002 Collins ..... E21B 17/00 175/62
6,640,897 B1 11/2003 Misselbrook et al.
6,739,803 B2 * 5/2004 Bass ..... F16L 9/18 405/184.5
9,719,329 B2 * 8/2017 Hradecky ..... E21B 41/00
10,053,926 B2 * 8/2018 Zheng ..... E21B 43/103
2003/0017007 A1 * 1/2003 Bass ..... F16L 9/18 405/154.1
2003/0075226 A1 * 4/2003 Codling ..... F16L 7/02 138/112
2003/0178842 A1 * 9/2003 Gallagher ..... E21B 17/18 285/123.15
2004/0086339 A1 * 5/2004 Tyrer ..... E21B 17/012 138/140
2004/0104052 A1 * 6/2004 Livingstone ..... E21B 17/18 175/55
2005/0103393 A1 * 5/2005 Foxton ..... F16L 59/143 138/148
2005/0212285 A1 * 9/2005 Haun ..... F16L 39/005 285/123.1
2006/0219407 A1 10/2006 Livingstone
2008/0066961 A1 * 3/2008 Aivalis ..... E21B 47/01 166/384
2016/0084013 A1 * 3/2016 Hradecky ..... E21B 41/00 166/380
2016/0084057 A1 3/2016 Castro et al.
2016/0208588 A1 * 7/2016 Snow ..... E21B 43/2401
2017/0122044 A1 * 5/2017 Zheng ..... E21B 23/14
2019/0195025 A1 * 6/2019 Tan ..... E21B 17/015
2022/0010632 A1 * 1/2022 Ward ..... E21B 17/20

* cited by examiner

SEALED CONCENTRIC COILED TUBING

CROSS-REFERENCE TO RELATED APPLICATION

The present application claims priority to U.S. Provisional Application No. 63/049,376, entitled "Sealed Concentric Coiled Tubing" and filed on Jul. 8, 2020, which is incorporated by reference herein in its entirety.

FIELD

Aspects of the present disclosure relate generally to systems and methods for extending reach in an oil well operation and more particularly to a sealed concentric coiled tubing deployed in an oil well operation.

BACKGROUND

Oil well operations in deviated wells, wells with long laterals, and/or the like include unique challenges. One challenge is that traditional tubing can be injected only so far into an oil well until friction forces between the tubing and the well wall become so great that the tubing experiences "lockup," also known as "helical lockup," where the tubing cannot be pushed any farther into the well. Thus, deviated wells and wells with longer laterals are difficult to access via traditional tubing to perform well operations, such as completion or intervention activities.

Some conventional systems for reaching father into oil wells include applying friction reducers to fluid systems to decrease the normal force of the tubing on the well wall. Other conventional systems include tractors on electric wireline that can reach into oil wells with long laterals. However, such conventional systems typically do not allow for circulation of fluids downhole, among other issues. It is with these observations in mind, among others, that various aspects of the present disclosure were conceived and developed.

SUMMARY

Implementations described and claimed herein address the foregoing problems by providing systems and methods for extending reach in a wellbore in oil well operations. In one implementation, a first coiled tubing string has a first coil interior surface, and a second coiled tubing string is disposed within the first coiled tubing string and has a second coil exterior surface. An annulus is defined by the first coil interior surface and the second coil exterior surface. The annulus is sealed proximal to a top end of the first coiled tubing string via a first seal and sealed proximal to a bottom end of the first coiled tubing string via a second seal. A fluid is sealed within the annulus at a pressure.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
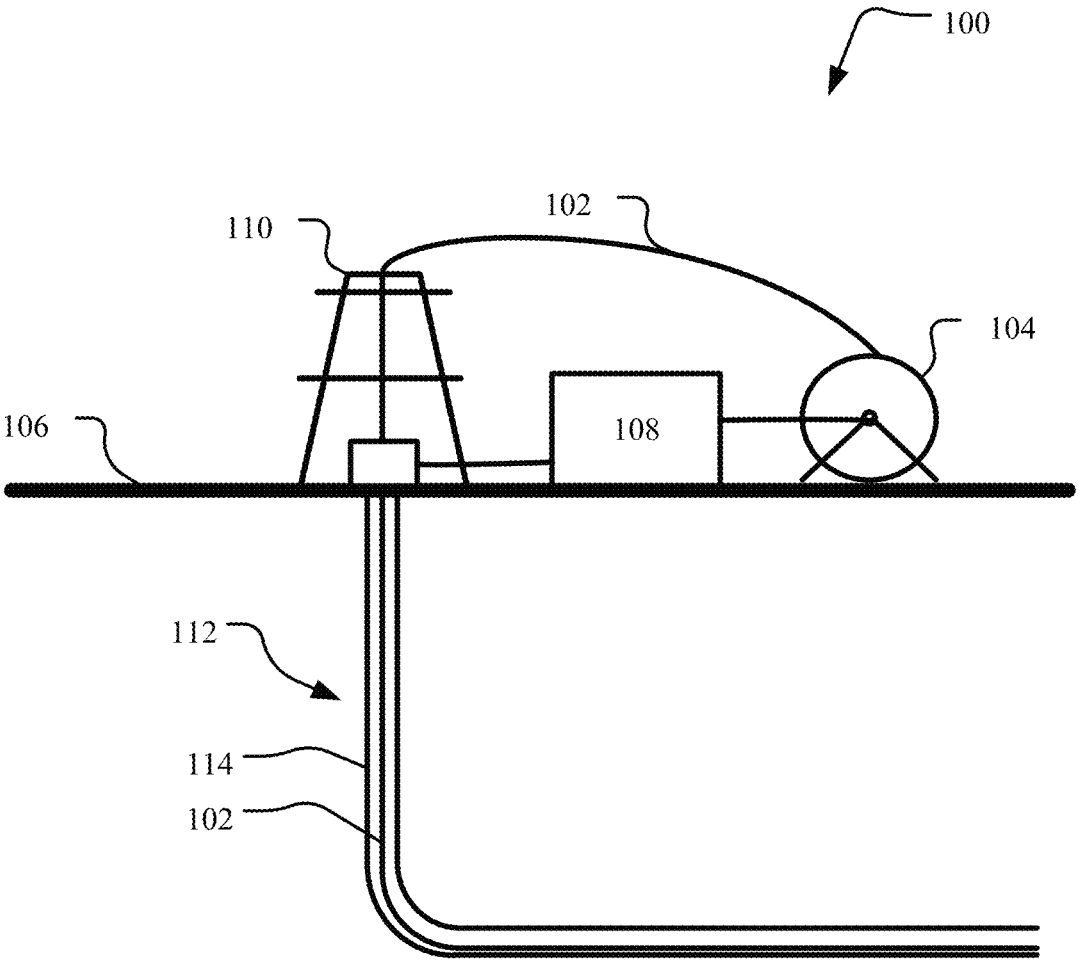
FIG. 1 illustrates an example well operation using an example sealed concentric coiled tubing (SCOT) system.

Aspects of the present disclosure involve systems and methods for improving coiled tubing in an oil well operation. Generally, the presently disclosed technology may be implemented in a sealed concentric coiled tubing (SCOT) system for extending reach in a wellbore in an oil well operation.

In one aspect, a SCCT system for extending reach in a wellbore in an oil well operation includes a first coiled tubing string disposed within a second coiled tubing string such that an interior of the first coiled tubing string and an exterior of the second coiled tubing string form an annulus. The first coiled tubing string and the second coiled tubing string are sealed by a first seal and a second seal, to create an annulus between the coiled tubing strings and a fluid is sealed within the annulus. The fluid-filled annulus is advantageous because it gives the composite SCOT string greater buoyancy in a working fluid compared to traditional coiled tubing strings, thereby decreasing friction between the SCCT string and the well wall by reducing the normal forces. An interior of the second coiled tubing string defines a channel through which well fluids may be pumped, treated, circulated, or produced.

The fluid-filled annulus of the SCCT system is advantageous over traditional coiled tubing and conventional techniques for several reasons. The fluid-filled annulus provides a relatively large volume of less dense annular space that can be conveyed downhole and is less dense than the well's fluids. Therefore, the SCCT system can have the same stiffness and strength of traditional coiled tubing strings, but when conveyed downhole in a well's fluids, the SCCT system has greater buoyancy than traditional coiled tubing. The increased buoyancy of the SCCT system decreases the normal force exerted on the well wall by the SCCT system and as such, decreases the overall friction force acting against the SCCT system. The SCCT system can also be deployed with friction reducers to further decrease the friction force acting on the SCCT system. The SCOT system can also be deployed with other extended reach techniques such as coil tractors, agitators, and other reach extending techniques. Stated differently, the SCCT system may compliment various coil tubing extended reach techniques as an additive. Further, unlike tractors on electric wireline, the ability to circulate fluids downhole and to produce well fluids to the surface is retained by the channel of the SCCT system.

The presently disclosed technology thus, among other advantages that will be apparent from the present disclosure, decreases the friction force between the SCCT string and the well wall by increasing the buoyancy of the SCCT in a well fluid while retaining stiffness and strength, and allows pumping or treating of well fluids through the channel, thereby extending reach in a wellbore in an oil well operation compared to traditional coiled tubing and conventional techniques.

I. Terminology

In the description, phraseology and terminology are employed for the purpose of description and should not be regarded as limiting. For example, the use of a singular term, such as "a", is not intended as limiting of the number of items. Also, the use of relational terms such as, but not limited to, "front" and "back" or "top" and "bottom", are used in the description for clarity in specific reference to the figure and are not intended to limit the scope of the present inventive concept or the appended claims.

Further, any one of the features of the present inventive concept may be used separately or in combination with any other feature. For example, references to the term "implementation" means that the feature or features being referred to are included in at least one aspect of the present inventive concept. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the present inventive concept may include a variety of combinations and/or integrations of the implementations described herein. Additionally, all aspects of the present inventive concept as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

As detailed herein, in one implementation, a system for extending reach in a wellbore in an oil well operation comprises a first coiled tubing string and a second coiled tubing string disposed within the first coiled tubing string. The diameter of the first coiled tubing string is greater than the diameter of the second coiled tubing string. A first seal is disposed between the first coiled tubing string and the second coiled tubing string. A second seal is disposed between the first coiled tubing string and the second coiled tubing string. The first seal and/or the second seal may be proximal to or at a first end or a second end of the first coiled tubing string. The first coiled tubing string, the second coiled tubing string, the first seal, and the second seal, define a sealed concentric coiled tubing string.

An annulus is formed by a void (e.g., a volume or space) between an interior surface of the first coiled tubing string and an exterior surface of the second coiled tubing string between the first seal and the second seal. A fluid is sealed within the annulus between the two seals at a value of pressure. The fluid may be a gas or liquid with a density less than that of well fluids. In some examples, the fluid may be air. In at least one example, the fluid may be nitrogen. However, the fluid may include other gases. In some examples, the fluid may be a light liquid, such as diesel or mineral oil. In other examples the fluid may be a combination of a liquid and a gas, a foam, a closed-cell extruded polystyrene foam, and/or other similar materials. In some cases, the pressure at which the fluid is sealed in the annulus does not exceed the mechanical limits of either the first coiled tubing string, the second coiled tubing string, the first seal, or the second seal. The sealed annulus may also accommodate wireline or fiber optic cables to facilitate communication with downhole tools.

A channel is defined by an interior surface of the second coiled tubing string. The channel may allow for the pumping or treating of fluids, or for the circulation and/or production of well fluids. In some examples, the first end and/or the second end of the first coiled tubing string may be attached to a coil connector (e.g., a coiled tubing string connector, a spool-able connector, a mechanical joining (e.g. welding), etc.) and/or a bottom-hole assembly (BHA). A BHA may be disposed at an end of the coil and may involve some equipment connected between two connected coiled strings in a system. In some examples, one or more sealed concentric coiled tubing systems may be connected via one or more coil connectors. In some examples, one or more coiled tubing systems may be combined in tandem with one or more sealed concentric coiled tubing systems.

Disconnection of the SCCT system from other coiled systems, connectors, or BHAs could be done by any means feasible, including, but not limited to cutting coil or mechanical disconnects. For example, in some implementations, the SCCT system is a lead coil system in long laterals, such that the SCCT system is connected and disconnected to a coil unit for long laterals for extended reach. In one example of such long laterals, the SCCT is an approximately 10-15 feet lead coil system, with a flush outer diameter and a spool-able ball drop disconnect between the coiled tubing and the SCOT.

In an additional implementation, a method for extending reach in a wellbore in an oil well operation includes the step of receiving a second coiled tubing string concentrically within a first coiled tubing string. The first coiled tubing string has a first coil interior surface and a first coil inner diameter. The second coiled tubing string has a second coil exterior surface and a second coil outer diameter. In one implementation, the first coil inner diameter is greater than the second coil outer diameter. In other implementations, the first coil diameter and the second coil diameter may vary along the length of the first coil and the second coil, respectively. Stated differently, the inner diameters may vary for both an inner and outer string along the length of the SCOT. In some cases, the outer diameter of the inner and/or outer strings of the coil may vary.

The first coil interior surface and the second coil exterior surface define an annulus. The method includes the step of receiving a fluid within the annulus. The fluid may be a gas or liquid with a density less than that of well fluids. In some examples, the fluid may be air. In at least one example, the fluid may be nitrogen. However, the fluid may include other gases. In some examples the fluid may be a light liquid, such as diesel or mineral oil. In other examples, the fluid may be a combination of a liquid and a gas, a foam, a closed-cell extruded polystyrene foam, or other similar materials. The method further includes the step of sealing the fluid within the annulus at a pressure. The pressure at which the fluid is sealed in the annulus does not exceed the mechanical limits of either the first coiled tubing string or the second coiled tubing string. In some examples, the method may include injecting the first coiled tubing string and the second coiled tubing string having the fluid sealed within the annulus into an oil well and conducting the oil well operation in the well. In some examples, the method may include changing the pressure at which the fluid is sealed within the annulus. The sealed annulus may also accommodate wireline or fiber optic cables between the coiled tubing strings to facilitate communication with downhole tools. The coiled tube strings may be made at atmospheric pressure on a long road, in a factory (e.g., shipped as a spool to a well operation and unspooled and re-spooled), or during well operations. Other implementations and advantages of the presently disclosed technology will be apparent from the following detailed description.

To begin a detailed description of the presently disclosed technology, reference is made first to FIG. 1, in which an example well operation 100 in accordance with the implementations described herein is illustrated. The well operation 100 generally comprises a sealed concentric coiled tubing (SCOT) system 102, wound on a tubing reel 104 situated on a surface 106. In one implementation, the well operation 100 includes a tubing injector 110 for injecting the SCOT system 102 into a wellbore 112. A power source 108 is in connection with the tubing reel 104 and the tubing injector 110. The well operation 100 includes the wellbore 112 having a well wall or casing 114 and the SCCT system 102 extending into the wellbore 112. The wellbore 112 may also include well fluids.

Figure 2:
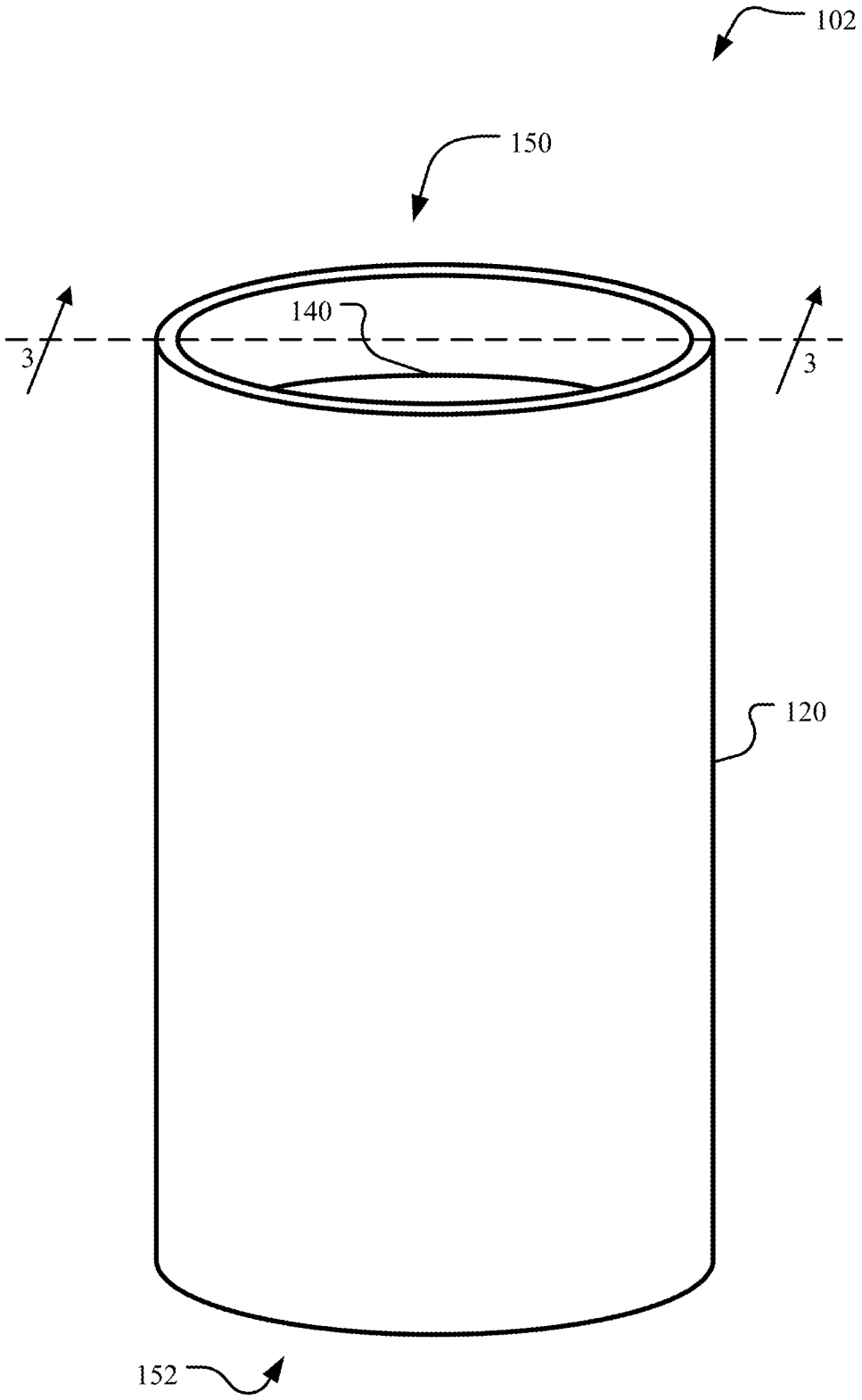
FIG. 2 illustrates an example SCCT system.
Figure 3:
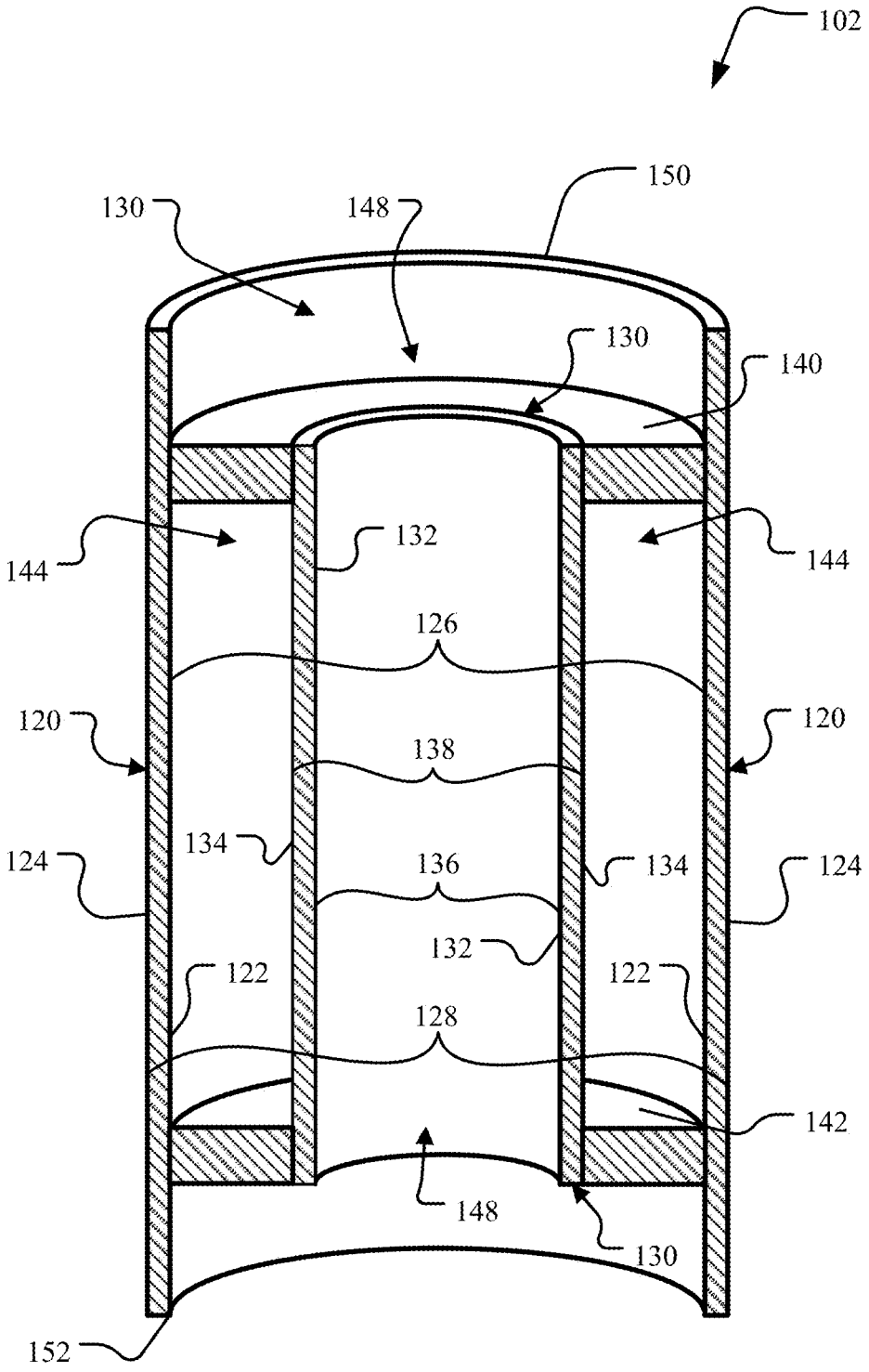
FIG. 3 shows a cross sectional view of the example SCCT system of FIG. 2, cut along line 3.

Turning to FIGS. 2 and 3, the SCCT system 102 for extending reach in a wellbore in an oil well operation is shown. The SCCT system 102 may be deployed in an oil well, for example, to extend reach in wellbore 112 in the well operation 100. In one implementation, the SCCT system 102 includes a first coiled tubing string 120 and a second coiled tubing string 130 disposed or placed concentrically through the first coiled tubing string 120. The first coiled tubing string 120 may have a length and the second coiled tubing string 130 may have a length that are equal or different. For example, the length the first coiled tubing string 120 may be longer than the length of the second coiled tubing string 130. Alternatively, the length of the second coiled tubing string 130 may be longer than the length of the first coiled tubing string 120. The length and thickness of the first coiled tubing string 120 and/or the length and thickness of the second coiled tubing string 130 may vary depending on the specific job or well type The first coiled tubing string 120 has a first coiled tubing string interior surface 122 and a first coiled tubing string exterior surface 124. The first coiled tubing string 120 also has a first coiled tubing string inner diameter 126 and a first coiled tubing string outer diameter 128. The first coiled tubing string inner diameter 126 is defined by the greatest distance between two points on the first coiled tubing string interior surface 122. The first coiled tubing string outer diameter 128 is defined by the greatest distance between two points on the first coiled tubing string exterior surface 124. Similarly, the second coiled tubing string 130 has a second coiled tubing string interior surface 132 and a second coiled tubing string exterior surface 134. The second coiled tubing string 130 also has a second coiled tubing string inner diameter 136 and a second coiled tubing string outer diameter 138. The second coiled tubing string inner diameter 136 is defined by the greatest distance between two points on the second coiled tubing string interior surface 132. The second coiled tubing string outer diameter 138 is defined by the greatest distance between two points on the second coiled tubing string exterior surface 134. The first coiled tubing string inner diameter 126 is greater than the second coiled tubing string outer diameter 138. The first coil diameter and the second coil diameter may vary along the length of the first coil and the second coil, respectively.

In some examples, the SCCT system 102 configurations (e.g., variations of the thickness of the first coiled tubing string 120 and/or the second coiled tubing string 130, the first coiled tubing string inner diameter 126, the first coiled tubing string outer diameter 128, the second coiled tubing string inner diameter 136, the second coiled tubing string outer diameter 138, and/or the materials used to construct the SCCT system 102) can be changed to optimize the SCCT system 102 for specific jobs or well types The SCCT system 102 includes a plurality of seals, such as a first seal 140 and a second seal 142, between the first coiled tubing string 120 and the second coiled tubing string 130. In one example, the first seal 140 and the second seal 142 are located at or near a first end 150 and a second end 152 of the first coiled tubing string 120, respectively. In one implementation, the SCOT system 102 provides mechanical strength with a connection to the coil system transmitting loads through the first and second coiled tubing strings 120, 130. For example, a male-female connection deployed inside a top of the first coiled tubing string 120 with a dimple/roll on may provide such mechanical strength. The seals 140-142 may be proximal to the end and include various terminations.

The SCCT system 102 includes an annulus 144 defined by the first coiled tubing string interior surface 122, the second coiled tubing string exterior surface 134, the first seal 140, and the second seal 142. A fluid 146 is sealed within the annulus 144 at some value of pressure. The fluid may be a gas or liquid with a density less than that of well fluids. In some examples, the fluid may be air. In at least one example, the fluid may be nitrogen. However, the fluid may include other gases. In some examples the fluid may be a light liquid, such as diesel or mineral oil. In other examples the fluid may be a combination of a liquid and a gas, a foam, a closed-cell extruded polystyrene foam, or other similar materials. The value of pressure of the fluid 146 is a value that would not exceed the mechanical limits of either the first coiled tubing string 120 or the second coiled tubing string 130. The value of pressure of the fluid 146 may be changed. For example, the value of pressure of the fluid 146 may be increased or decreased to provide structural support for the SCCT system 102. In some examples, the seals may be configured to allow the pressure at which the fluid 146 is sealed within the annulus to be changed. The sealed annulus may also accommodate wireline or fiber optic cables to facilitate communication with downhole tools.

The SCCT system 102 includes a channel 148 defined by the second coiled tubing string interior surface. The channel 148 allows for pumping, treating, circulation, or production of well fluids through the SCCT system 102 to the surface 106. The diameter of the channel 148 is equal to the second coiled tubing string inner diameter 136. Channel diameter may vary along the length of the channel.

Figure 4:
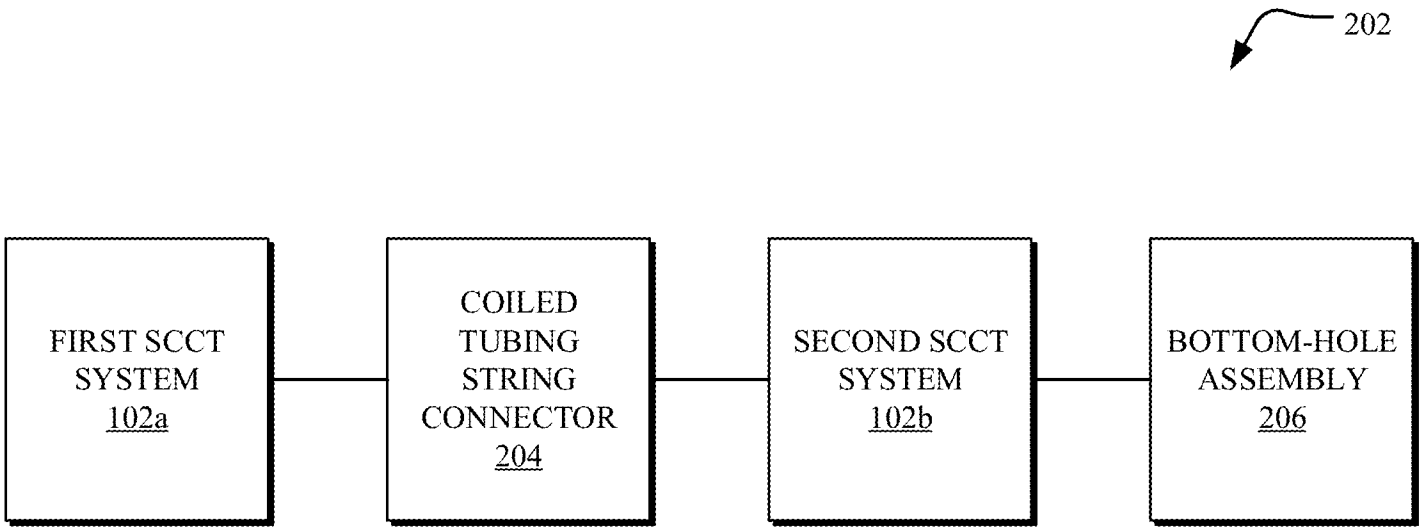
FIG. 4 illustrates additional features of the example SCCT system of FIG. 2.

The first end 150 and/or the second end 152 of the first coiled tubing string 120 may be attached to a coil connector 204 (e.g., a coiled tubing string connector or a spool-able connector) and/or a bottom-hole assembly. Referring to FIG. 4 illustrating an example SCCT system 202 for extending reach in a wellbore in an oil well operation, one or more SCCT systems 102 may be connected via the coil connector 204. It is foreseen that the coil connector 204 may be one or more coil connectors. In FIG. 4, a first SCCT system **102*a* and a second SCCT system 102*b* are connected via the coil connector 204. A bottom-hole assembly 206 is connected to the second SCOT system 102*b***.

Figure 5:
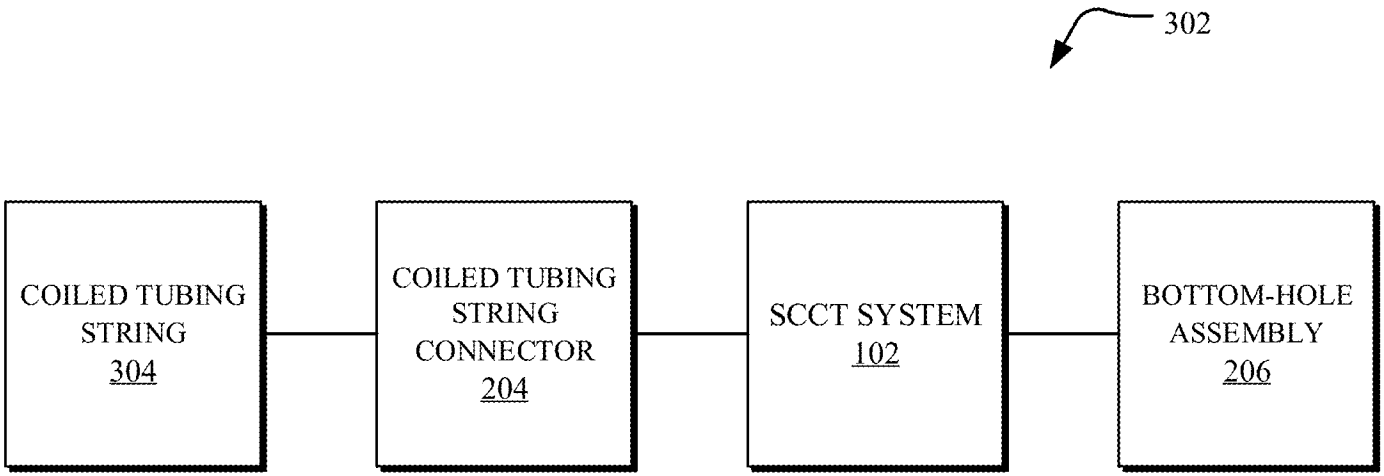
FIG. 5 illustrates additional features of the example SCCT system of FIG. 2.

In some implementations, the SCCT system 102 of FIG. 1 may be combined in tandem with one or more coiled tubing strings, as shown in FIG. 5. In FIG. 5, a SCCT system 302 for extending reach in a wellbore in an oil well operation is shown. In system 302, a coiled tubing string 304 is connected to SCCT system 102 via coiled tubing string connector 204. A bottom-hole assembly 206 is connected to the SCCT system 102.

Figure 6:
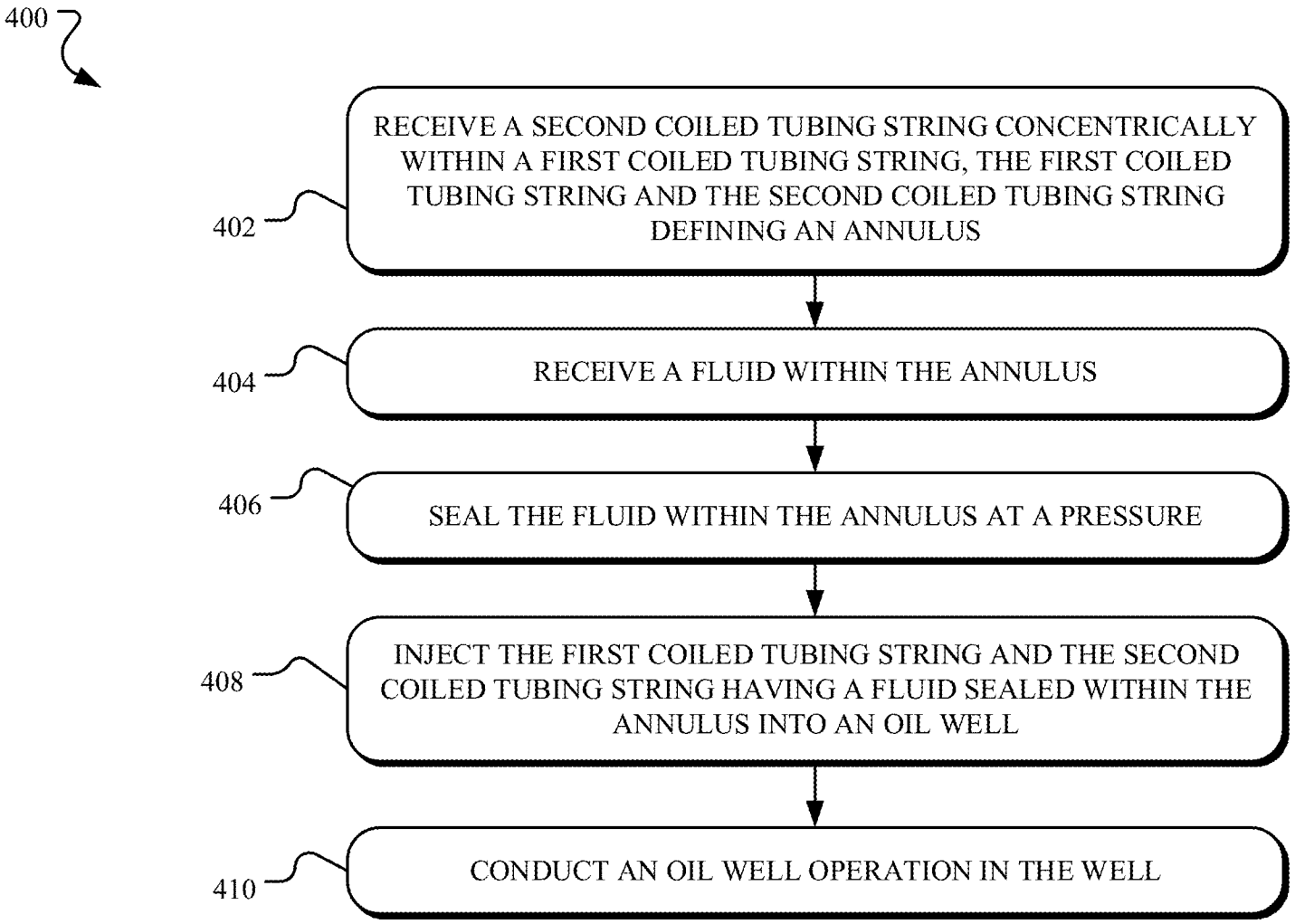
FIG. 6 illustrates an example method for implanting the SCCT system of FIG. 2.

In FIG. 6, an example method 400 for extending reach of coiled tubing in a wellbore in an oil well operation is shown. In the method 400, step 402 includes receiving the second coiled tubing string 130 concentrically within the first coiled tubing string 120. Step 404 includes receiving a fluid 146 within the annulus 144. Step 406 includes sealing the fluid 146 within the annulus 144. The fluid 146 is sealed within the annulus 144 at a value of pressure that does not exceed the mechanical limits of either the first coiled tubing string 120 or the second coiled tubing string 130. In some examples, the method may include step 408 injecting the first coiled tubing string and the second coiled tubing string having the fluid sealed within the annulus into a well. In some examples, the method may include step 410 conducting an oil well operation in the well. In some examples, the method may include changing the value of the pressure of the fluid 146. For example, the value of pressure of the fluid 146 may be increased or decreased to provide structural support to the SCCT system 102. The sealed annulus may also accommodate wireline or fiber optic cables to facilitate communication with downhole tools.

Sealing the fluid within the annulus 144 creates a less dense space within the SCOT system 102. Thus, when this less dense annular space is conveyed downhole into a well's fluids, the buoyancy of the SCCT system 102 is increased compared to a coiled tubing system without the fluid 146 sealed within the annulus 144 at a value of pressure. As such, the normal force exerted on the well wall by the SCCT system 102 is less than the normal force that the first coiled tubing string 120 would exert by itself. This decreases normal force, thereby decreasing normal force between the SCCT system 102 and the well wall, allowing for farther reach into an oil well.

It will be appreciated that the SCCT systems 102, 202, 302 and the method 400 are exemplary only and other systems or modifications to these systems may be used to eliminate or otherwise extend reach in an oil well in accordance with the presently disclosed technology.

It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A system for extending reach in a well having a well wall, the system comprising:

a first coiled tubing string having a first coil interior surface, the first coiled tubing string having a first length;

a second coiled tubing string disposed within the first coiled tubing string and having a second coil exterior surface, the second coiled tubing string having a second length, the first length being different than the second length; and an annulus defined by the first coil interior surface and the second coil exterior surface, the annulus sealed proximal to a top end of the first coiled tubing string via a first seal and sealed proximal to a bottom end of the first coiled tubing string via a second seal, a fluid being sealed within the annulus by the first and second seals at a pressure prior to deployment in the well.

2. The system of claim 1, wherein the first coiled tubing string, the second coiled tubing string, the first seal, and the second seal define a sealed concentric coiled tubing string configured for deployment in the well.

3. The system of claim 2, wherein the annulus is configured to generate a buoyancy of the sealed concentric coiled tubing string relative to well fluids in the well using the fluid sealed within the annulus, the buoyancy decreasing a force exerted on the well wall.

4. The system of claim 2, wherein the first seal is proximal to a first end of the sealed concentric coiled tubing string and the second seal is proximal to a second end of the sealed concentric coiled tubing string.

5. The system of claim 2, further comprising:

a coil connector coupled to the sealed concentric coiled tubing string; and a coiled tubing system connected to the coil connector.

6. The system of claim 2, further comprising:

a bottom-hole assembly coupled to the sealed concentric coiled tubing string.

7. The system of claim 1, wherein the first seal is disposed between the first coiled tubing string and the second coiled tubing string and the second seal is disposed between the first coiled tubing string and the second coiled tubing string.

8. The system of claim 1, wherein the first coiled tubing string has an inner diameter and the second coiled tubing string has an outer diameter, the inner diameter of the first coiled tubing string being greater than the outer diameter of the second coiled tubing string.

9. The system of claim 1, wherein the second coiled tubing string has a second coil interior surface, the second coil interior surface defining a channel, the channel facilitating one or more of circulation, pumping, and treating of well fluids.

10. The system of claim 1, wherein the fluid includes a gas.

11. The system of claim 1, wherein the pressure does not exceed mechanical limits of one or more of the first coiled tubing string, the second coiled tubing string, the first seal, and the second seal.

12. The system of claim 1, wherein the first seal and the second seal are configured to permit a change to the pressure.

13. The system of claim 1, wherein the first length is greater than the second length.

14. A method for extending reach in a well having a well wall, the method comprising:

receiving a second coiled tubing string concentrically within a first coiled tubing string;

receiving a fluid within an annulus, the annulus defined by a first coil interior surface of the first coiled tubing string and a second coil exterior surface of the second coiled tubing string, wherein the first coiled tubing string has a first length, and the second coiled tubing string has a second length, the first length being different than the second length;

receiving a first seal proximal to a top end of the first coiled tubing string; and receiving a second seal proximal to a bottom end of the first coiled tubing string, the first seal and the second seal sealing the fluid within the annulus at a pressure prior to deployment in the well.

15. The method of claim 14, wherein the first coiled tubing string, the second coiled tubing string, the first seal, and the second seal define a sealed concentric coiled tubing string configured for deployment in the well.

16. The method of claim 15, further comprising:

decreasing a force exerted on the well wall using a buoyancy of the sealed concentric coiled tubing string relative to well fluids in the well.

17. The method of claim 16, wherein the buoyancy is generated using the fluid sealed within the annulus.

18. The method of claim 14, further comprising:

changing the pressure using at least one of the first seal or the second seal.

19. The method of claim 14, further comprising:

circulating well fluids in the well using a channel, the channel defined by a second coil interior surface of the second coiled tubing string.

20. The method of claim 14, wherein the first length is greater than the second length.

* * * * *